US008699906B2

(12) United States Patent
Miyamoto et al.

(10) Patent No.: US 8,699,906 B2
(45) Date of Patent: Apr. 15, 2014

(54) PRINTING SYSTEM PROVIDED WITH PREHEATERS

(75) Inventors: Atsushi Miyamoto, Ibaraki (JP); Soushi Kikuchi, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 603 days.

(21) Appl. No.: 12/887,083

(22) Filed: Sep. 21, 2010

(65) Prior Publication Data

US 2011/0076042 A1 Mar. 31, 2011

(30) Foreign Application Priority Data

Sep. 25, 2009 (JP) ..... 2009-220010
Aug. 13, 2010 (JP) ..... 2010-181443

(51) Int. Cl.
*G03G 15/20* (2006.01)

(52) U.S. Cl.
USPC ..... 399/70; 399/306; 399/384

(58) Field of Classification Search
USPC ..... 399/69, 70, 306, 384, 400
See application file for complete search history.

(56) References Cited

FOREIGN PATENT DOCUMENTS

| | | |
|---|---|---|
| JP | 2004-238165 | 8/2004 |
| JP | 2002-187660 | 5/2005 |
| JP | 2008-129123 | 6/2008 |
| JP | 2008-230185 | 10/2008 |
| JP | 2009-53288 | 3/2009 |
| JP | 2010-32572 | 2/2010 |

*Primary Examiner* — David Gray
*Assistant Examiner* — Laura Roth
(74) *Attorney, Agent, or Firm* — Oblon, Spivak, McClelland, Maier & Neustadt, L.L.P.

(57) ABSTRACT

A printing system includes a first printing apparatus, a second printing apparatus, and a control device. The second printing apparatus is provided at a rear stage of the first printing apparatus, and includes a second preheating unit that preheats a recording medium from one surface before thermally fixing a toner image to another surface, and a temperature control unit that increase the temperature of the second preheating unit from a normal temperature to a target temperature, in response to a printing preparation instruction received in a temporary printing stop state from the control device. The control device starts printing, when the temperature of the second preheating unit reaches the target temperature. The temperature control unit decreases the temperature of the second preheating unit from the target temperature to the normal temperature, when the recording medium is conveyed by a length from a deformed portion to the second preheating unit.

11 Claims, 10 Drawing Sheets

PRINTING SYSTEM PROVIDED WITH PREHEATERS

CROSS-REFERENCE TO RELATED APPLICATIONS

The present application claims priority to and incorporates by reference the entire contents of Japanese Patent Application No. 2009-220010 filed in Japan on Sep. 25, 2009 and Japanese Patent Application No. 2010-181443 filed in Japan on Aug. 13, 2010.

BACKGROUND OF THE INVENTION

1. Field of the Invention

The present invention relates to a printing system, a printing apparatus, and a printing method.

2. Description of the Related Art

As a printing system that forms an image on both sides of a web, a web printing system that is disclosed in Japanese Patent No. 3680989 is suggested and is put to practical use. In the web printing system, two printing apparatuses are disposed in series, printing is performed on a first surface (front surface) of a web W using one printing apparatus (hereinafter, referred to as "first printing apparatus") at a front stage, the web that is discharged from the first printing apparatus is then reversed by a reversing device T, the web W is fed to the other printing apparatus (hereinafter, referred to as "second printing apparatus") at a rear stage, and printing is performed on a second surface (back surface) of the web using the second printing apparatus. This web printing system includes a control device that controls the operation of the first printing apparatus and the second printing apparatus.

Each of the printing apparatuses is an electrophotographic printing apparatus that heats, melts, and fixes a transferred toner image, and has a photosensitive drum, a developing device, and a heat fixing device. Specifically, each of the printing apparatuses has a photosensitive drum, a preheater, a heating roll, a pressurizing roll, and a puller roll. In this case, the preheater is a hot platen that preheats the web, and previously increases the temperature of the web and stabilizes fixing performance in the heating roll and the pressurizing roll.

In a web printing system 10, as an example of a printing preparation operation before printing starts, the photosensitive drum that is stopped at the time of non-printing rotates until the velocity thereof becomes a predetermined velocity, the temperature of the preheater of the heat fixing device is increased to a predetermined temperature, or the concentration of a toner in the developing device is adjusted to become a predetermined level at the time of printing.

In the web printing system that has the above configuration, if a printing operation is temporarily stopped due to occurrence of failure or an operator temporarily stops the printing operation due to other circumstances, the web is left loaded on the first printing apparatus and the second printing apparatus in a non-printing state. If this state is generated, the web that is stopped in the heat fixing device of the first printing apparatus is continuously heated by the preheater and the heating roll, the moisture of the web is evaporated as time passes, and a portion of the web is greatly thermally contracted and deformed.

In this state, if the printing restarts, the web having the portion (hereinafter, referred to as thermally contracted deformed portion) that is discharged from the first printing apparatus and is greatly thermally contracted and deformed is reversed by the reversing device and is fed to the second printing apparatus. When the thermally contracted deformed portion passes through the upper side of the preheater of the second printing apparatus, adhesion of the web W with the preheater is lowered due to the deformation, the heat cannot be sufficiently obtained from the preheater, and the preheating of the web W before the web enters the heating roll and the pressurizing roll may be insufficient. As a result, the amount of heat that is received by the toner image is insufficient and a local fixing defect occurs.

In order to solve the above problems, for example, in a technology that is disclosed in Japanese Patent Application Laid-open No. 2009-53288, each of the first printing apparatus and the second printing apparatus has a preheater to fix an image to the web W and a mechanism (hereinafter, referred to as "suction mechanism") to suck the web to the preheater. In this conventional system, the suction mechanism has a mechanism that can change the suction force, and at least the second printing apparatus has a unit that grasps the length of one page of the web W to be printed and a unit that grasps the number of pages of the web W existing between the first printing apparatus and the second printing apparatus. During a period where the web stopped on the preheater of the first printing apparatus passes through the second printing apparatus, the suction force of the suction mechanism is controlled to be increased.

However, in the configuration of this system, when a long web is used, if the suction force in the suction mechanism is increased, this affects the anterior and posterior conveyance forces of the suction mechanism on a conveyance path. As a result, a paper travel is disturbed and a behavior of the web is disturbed in a place where an image is transferred to the web. For this reason, a printed product where an image is blurred and an image quality is bad may be generated.

In the case where the printing apparatus includes a mechanism that contacts the web, such as a pair of rollers nipping the web, when the printing operation is stopped for a long time, the thermally contracted deformed portion is generated, and the same part of the web contacts the corresponding mechanism for a long time, which may result in generating deformation, such as bending, in the portion of the web that contacts the mechanism.

In this state, if the printing restarts, when the web W having the deformed portion passes through the upper side of the preheater, because of the same reason as the reason described above, the preheating of the web may be insufficient, the amount of heat that is received by the toner image may be insufficient, and the local fixing defect may be generated.

SUMMARY OF THE INVENTION

It is an object of the present invention to at least partially solve the problems in the conventional technology.

According to one aspect of the present invention, a printing system includes a first printing apparatus, a second printing apparatus, and a control device. The second printing apparatus is provided at a rear stage of the first printing apparatus. The second printing apparatus includes a second preheating unit that preheats a recording medium from a first surface of the recording medium that is the opposite side of a second surface of the recording medium, before thermally fixing a toner image to the second surface, and a temperature control unit that performs control to increase the temperature of the second preheating unit from a normal temperature to a target temperature, if a printing preparation instruction is received from a control device when the printing system is in a temporary printing stop state that lasts until printing restarts from when the printing is performed once. The control device controls a printing operation of each of the first and second printing apparatuses, the control device starts printing of the first and second printing apparatuses, when the temperature of the second preheating unit reaches the target temperature. The temperature control unit performs control to decrease the temperature of the second preheating unit from the target temperature to the normal temperature, when the recording medium is conveyed by a length corresponding to the length of the recording medium loaded on a conveyance path of the recording medium from a deformed portion of the recording medium to the second preheating unit after the printing starts.

According to another aspect of the present invention, A printing apparatus, includes: a preheating unit that preheats a long recording medium from a second surface of the recording medium that is the opposite surface of a first surface of the recording medium, before thermally fixing a toner image to the first surface; a contact member that contacts the recording medium in front of the preheating unit; a temperature control unit that performs control to increase the temperature of the preheating unit from a normal temperature to a target temperature, if a printing preparation instruction is received when the printing apparatus is in a temporary printing stop state that lasts until printing restarts from when the printing is performed once; and a control unit that starts the printing, when the temperature of the preheating unit reaches the target temperature. The temperature control unit performs control to decrease the temperature of the preheating unit from the target temperature to the normal temperature, when the recording medium is conveyed by a length corresponding to the length of the recording medium loaded on a conveyance path of the recording medium from the contact member to the preheating unit after the printing starts.

According to still another aspect of the present invention, a printing method that is executed in a printing system including a first printing apparatus, a second printing apparatus provided at a rear stage of the first printing apparatus, and a control device to control a printing operation of each of the first and second printing apparatuses, in which the second printing apparatus includes a second preheating unit that preheats a recording medium from a first surface of the recording medium that is the opposite side of a second surface of the recording medium, before thermally fixing a toner image to the second surface, the printing method includes: causing the second printing apparatus to perform control to increase the temperature of the second preheating unit from a normal temperature to a target temperature, if a printing preparation instruction is received from the control device when the printing system is in a temporary printing stop state that lasts until printing restarts from when the printing is performed once; causing the control device to start printing of the first and second printing apparatuses, when the temperature of the second preheating unit reaches the target temperature; and causing the second printing apparatus to perform control to decrease the temperature of the second preheating unit from the target temperature to the normal temperature, when the recording medium is conveyed by a length corresponding to the length of the recording medium loaded on a conveyance path of the recording medium from a deformed portion of the recording medium to the second preheating unit after the printing starts.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of a printing system, a printing apparatus, and a printing method according to the invention will be described in detail with reference to the accompanying drawings.

Figure 1:
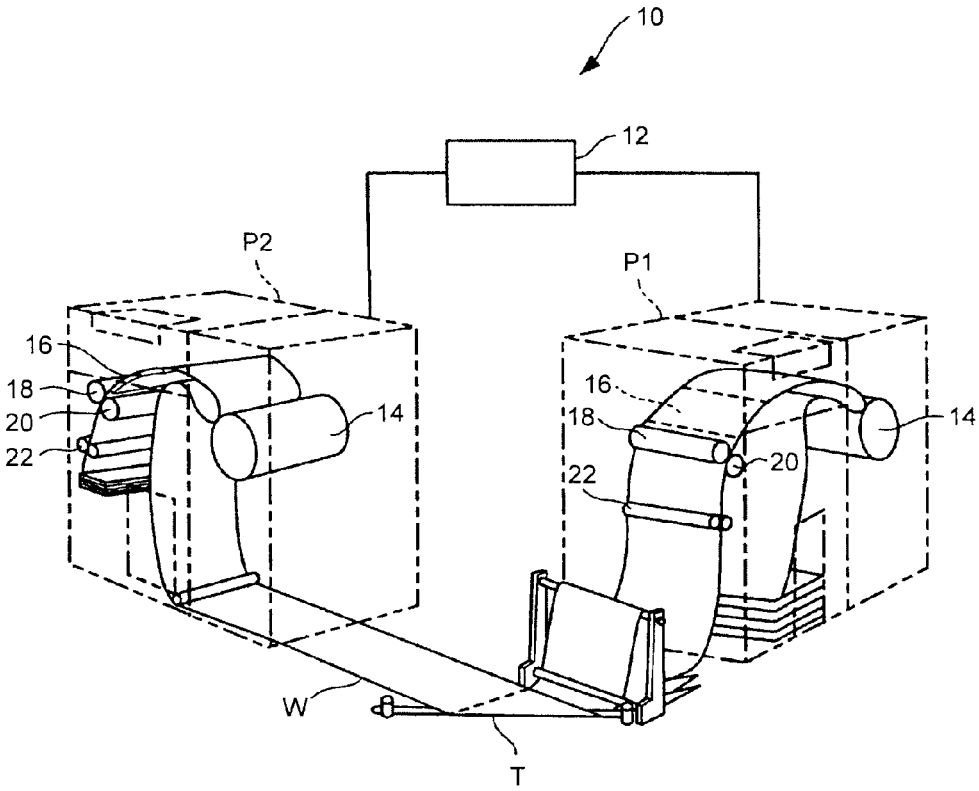
FIG. 1 is a diagram showing the basic configuration of a web printing system.

FIG. 1 shows the basic configuration of a web printing system 10 according to the first embodiment. The basic configuration of web printing systems according to second to fifth embodiments to be described below is the same as the basic configuration of the web printing system 10 shown in FIG. 1.

In the web printing system 10 according to the first embodiment, two printing apparatuses are disposed in series, printing is performed on a first surface (front surface) of a web W using a printing apparatus (hereinafter, referred to as "first printing apparatus") P1 of a front stage. After the web W discharged from the first printing apparatus P1 is reversed by a reversing device T, the web W is fed to a printing apparatus (hereinafter, referred to as "second printing apparatus") P2 of a rear stage, and printing is performed on a second surface (back surface) of the web using the second printing apparatus P2.

This web printing system 10 includes a control device (hereinafter, referred to as "controller") 12 that controls the operation of each of the first and second printing apparatuses P1 and P2.

Each of the printing apparatuses P1 and P2 is an electrophotographic printing apparatus that heats, melts, and fixes a transferred toner image, and has a photosensitive drum, a developing device, and a heat fixing device. FIG. 1 shows simplification of a structure of each of the printing apparatuses. Each of the printing apparatuses P1 and P2 has a photosensitive drum 14, a preheater 16, a heating roll 18, a pressurizing roll 20, and a puller roll 22. The preheater 16, the heating roll 18, and the pressurizing roll 20 constitute a portion of the heat fixing device. The preheater 16 is a hot platen that preheats the web, and previously increases the temperature of the web and stabilizes fixing performance in the heating roll 18 and the pressurizing roll 20.

In the web printing system 10, when printing starts, first, a printing preparation command (hereinafter, referred to as "ACTIVATE command") is output from the controller 12 to the web printing system 10 before the printing. If each of the printing apparatuses P1 and P2 receives the ACTIVATE command, driving or adjustment operations of devices in each of the printing apparatuses start, such that the printing is enabled.

As an example of the printing preparation operation, the photosensitive drum 14 that is stopped at the time of non-printing rotates until the velocity thereof becomes a predetermined velocity, the temperature of the preheater 16 of the heat fixing device is increased to a predetermined temperature, or the concentration of a toner in the developing device is adjusted to become a predetermined level at the time of the printing.

If a printing start preparation is completed, each of the printing apparatuses P1 and P2 causes a DORMANT signal indicating the printing preparation completion to become OFF. The controller 12 recognizes that the printing start preparation of each of the printing apparatuses is completed, from the OFF state of the DORMANT signal, and instructs each of the printing apparatuses to start the printing.

Figure 2:
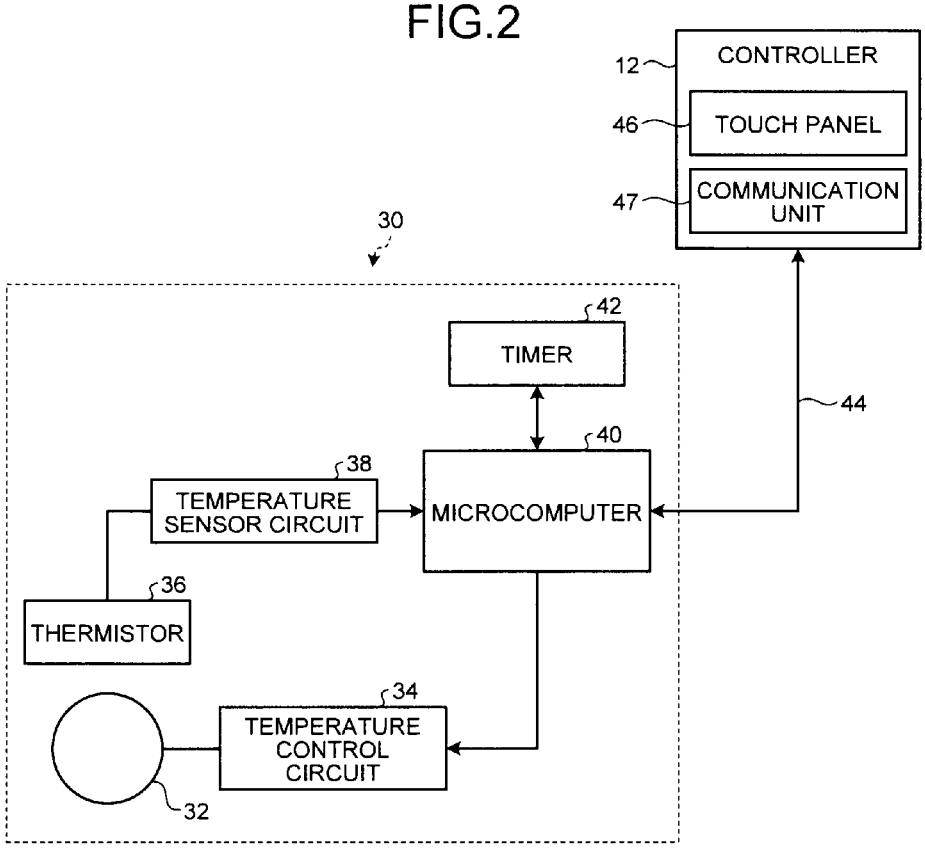
FIG. 2 is a diagram showing an example of the configuration of a temperature control unit according to a first embodiment.
Figure 3:
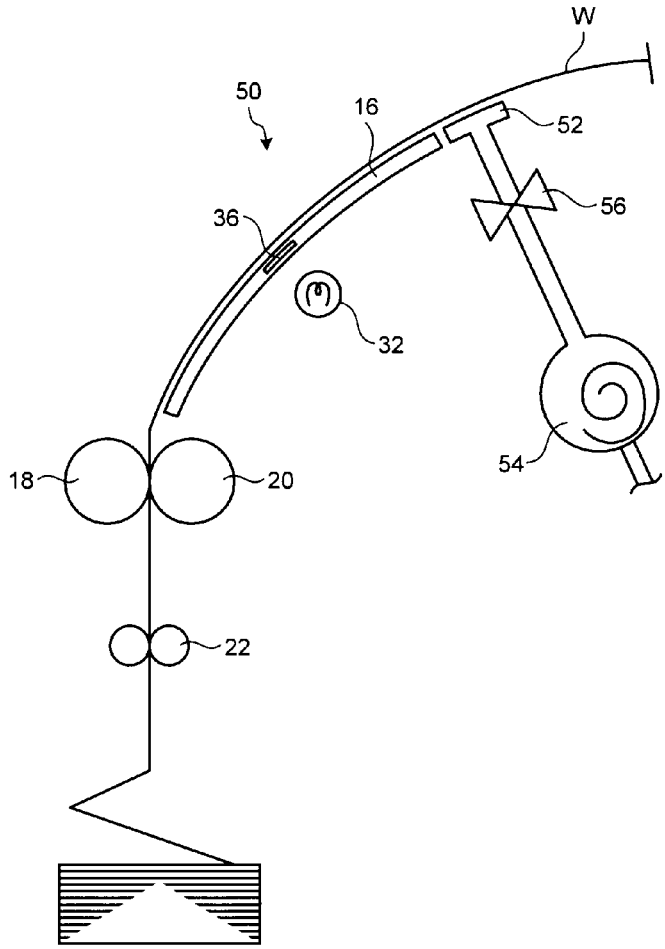
FIG. 3 is a diagram showing the configuration of a heat fixing device of a second printing apparatus.

The second printing apparatus P2 of the web printing system 10 according to the first embodiment includes a temperature control unit that controls the rising temperature of the preheater 16. The rising temperature refers to the temperature of the preheater 16 increased from the normal temperature to the target temperature. FIG. 2 shows an example of the hardware configuration of the temperature control unit according to the first embodiment. FIG. 3 schematically shows a horizontal section of the heat fixing device of the second printing apparatus P2. In FIG. 3, the same components as those of FIG. 1 are denoted by the same reference numerals.

In FIG. 2, a temperature control unit 30 of the second printing apparatus P2 has a heating lamp 32, a temperature control circuit 34, a thermistor 36 functioning as a temperature detecting sensor, a temperature sensor circuit 38, a microcomputer 40, and a timer 42 functioning as a timing unit.

The heating lamp 32 heats the preheater 16. The temperature control circuit 34 controls the rising temperature of the heating lamp 32, that is, the rising temperature of the preheater 16. The thermistor 36 detects the temperature of the preheater 16. The temperature sensor circuit 38 converts an output of the thermistor 36 into an electric signal. The microcomputer 40 controls the operation of the second printing apparatus P2. The timer 42 counts time.

The heating lamp 32 increases the temperature of the preheater 16 from the normal temperature to the target temperature. A heat source that heats the preheater 16 at the normal temperature is a sheath heater that is buried in the preheater 16. The temperature control of the heat source that heats the preheater at the normal temperature is performed using a known method. As the heating lamp 32, for example, a heater lamp can be used.

Although not shown in the drawings, the first printing apparatus P1 also has a temperature control unit that is the same as the temperature control unit 30 of the second printing apparatus P2.

In a heat fixing device 50 of the second printing apparatus P2 shown in FIG. 3, the thermistor 36 is buried in the preheater 16. The heating lamp 32 is provided in the vicinity of the preheater 16. On the web W that is conveyed to the heat fixing device 50, a toner image of printing data that is transferred by a transfer unit (not shown in the drawings) is formed. The toner image of the web W is preheated by the preheater 16, is heated and pressurized by the heating roll 18 and the pressurizing roll 20, and is melted and fixed to the web W. The web W where the toner image is fixed is drawn by the puller roll 22, is folded back, and is stacked.

A suction 52 is an air sucking device that is provided to cause the web W where the toner image is formed to come close to the preheater 16 and improve efficiency of preheating. The air suction is performed by a blower 54. A switching valve 56 is provided to release the air suction of the suction 52, when the web does not need to be sucked, for example, when the web W is first loaded on the heat fixing device 50.

Although not shown in the drawings, the first printing apparatus P1 also has a heat fixing device that has the same configuration as that of the heat fixing device 50 of the second printing apparatus P2.

As shown in FIG. 1, the web printing system 10 has the controller 12 that controls a printing operation of the first printing apparatus P1 and the second printing apparatus P2. A microcomputer of each of the first printing apparatus P1 and the second printing apparatus P2 is connected to the controller 12 through a communication unit 44. In FIG. 2, the communication unit 44 is simply shown by a solid line. The communication unit 44 is realized by wired communication, wireless communication or optical communication.

The controller 12 has a communication unit 47 that reads information through a communication function with the microcomputer 40 of each of the first and second printing apparatuses P1 and P2, and a touch panel 46 that functions as an input unit to receive an input of predetermined information from an operator.

In the web printing system 10 having the above configuration, the temperature of the preheater 16 of the second printing apparatus P2 is managed by the microcomputer 40. An output of the thermistor 36 is converted into an electric signal by the temperature sensor circuit 38, the conversion signal is read by the microcomputer 40, and the microcomputer 40 recognizes the temperature of the preheater 16.

Meanwhile, the microcomputer 40 instructs the temperature control circuit 34 to turn on/off the heating lamp 32, and thereby turns on/off the heating lamp 32. Thereby, heating and heating stop of the preheater 16 are controlled.

Figure 4:
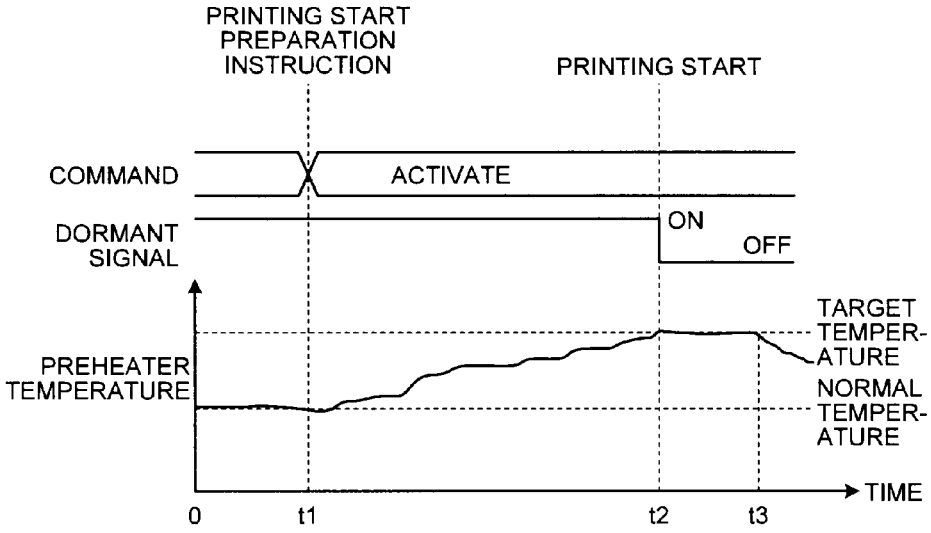
FIG. 4 is a diagram showing a command from a controller and a temperature change of a preheater at the time of restarting printing.
Figure 5:
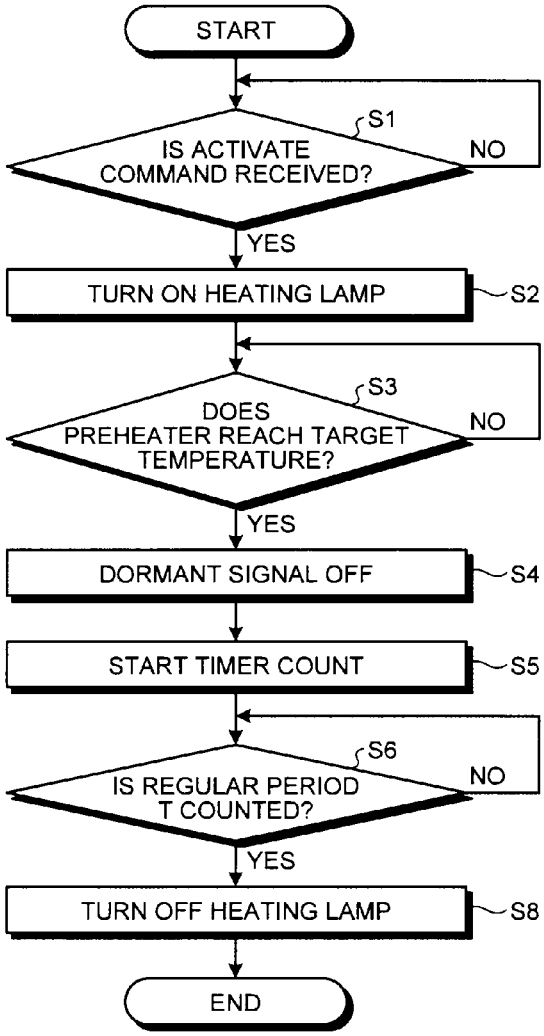
FIG. 5 is a flowchart illustrating a sequence of a temperature control process according to the first embodiment.

An operation of the web printing system 10 according to the first embodiment will be described with reference to FIGS. 4 and 5. FIG. 4 shows a command from the controller 12 and a temperature change of the preheater 16 at the time of restarting printing. FIG. 5 is a flowchart illustrating a sequence of a temperature control process based on the microcomputer 40 according to the first embodiment.

After the web printing system 10 executes a printing process once, when the web printing system 10 is in a temporary printing stop state, the preheater 16 of each of the first and second printing apparatuses P1 and P2 is heated at the normal temperature by the heat source buried in the preheater. At this time, the web W is continuously heated by the heating roll 18 and the preheater 16 of each of the first and second printing apparatuses P1 and P2, and a portion of the web W is greatly thermally contracted and a thermally contracted deformed portion exists in the web W. In this case, when the thermally contracted deformed portion generated by the first printing apparatus P1 reaches the preheater 16 of the second printing apparatus P2, adhesion of the web with the preheater 16 is bad and sufficient preheating cannot be provided.

In the web printing system 10 according to the first embodiment, when the printing restarts, if the microcomputer 40 of the second printing apparatus P2 receives an ACTIVATE command corresponding to a printing start preparation instruction from the controller 12 at time t1 (Yes in step S1), the microcomputer 40 performs a printing preparation operation and instructs the temperature control circuit 34 to turn on the heating lamp 32 corresponding to the heat source of the preheater 16 to increase the temperature of the preheater 16 from the normal temperature to the target temperature by the rising temperature previously set to the microcomputer 40. Thereby, the heating lamp 32 is turned on to heat the preheater 16 (step S2).

The temperature of the preheater 16 is detected by the thermistor 36, is converted into an electric signal by the temperature sensor circuit 38, and is transmitted to the microcomputer 40. The microcomputer 40 continuously monitors the temperature of the preheater 16 and monitors whether the temperature of the preheater 16 reaches the target temperature held by the microcomputer 40 (step S3). In this case, the target temperature means the temperature that corresponds to the amount of heat of the preheating, which is applied to the back surface of the web where the thermally contracted deformed portion exists and needed to melt and fix the toner image in the heat fixing device 50 of the second printing apparatus P2. The target temperature is different according to the external temperature or the ream weight or type of paper. However, in the first embodiment, the target temperature is set to the temperature that is higher than the normal temperature by approximately 10° C.

In this case, the reason why a waiting state is maintained until the temperature of the preheater 16 reaches the target temperature in step S3 of FIG. 5 is as follows.

First, if conveyance of the web W starts when the printing starts, the temperature of the preheater 16 temporarily decreases. This reason will be described. Even though the target temperature of the preheater 16 is set to the same temperature during the printing stop and the conveyance of the web W, the conveyed web W takes heat away from the preheater 16 during the conveyance of the web W. For this reason, the amount of heat that is supplied from the heat source needs to become larger than the amount of heat during the printing stop. Accordingly, when a state of the web W is switched from a stop state to a conveyance start state, the amount of heat that is supplied from the heat source becomes temporarily insufficient, and the temperature of the preheater 16 decreases.

In the first embodiment, when the waiting state is not maintained until the temperature of the preheater 16 reaches the target temperature in step S3 of FIG. 5 and the printing starts, it can be expected that time needed until the temperature of the preheater 16 reaches the target temperature is increased as compared with the usual case. Accordingly, in the first embodiment, the waiting state is maintained until the temperature of the preheater 16 reaches the target temperature in step S3.

If the temperature of the preheater 16 reaches the target temperature at time t2 (Yes in step S3), the microcomputer 40 causes the DORMANT signal supplied to the controller 12 to become OFF to cause the second printing apparatus P2 to inform the printing preparation completion (step S4). If the controller 12 recognizes that the DORMANT signal becomes OFF at the time t2, the controller 12 instructs the microcomputer 40 of each of the first and second printing apparatuses P1 and P2 to start the printing operation.

If the thermally contracted deformed portion of the web W reaches the preheater 16 of the second printing apparatus P2, the thermally contracted deformed portion is preheated by the preheater 16 at the target temperature higher than the normal temperature. Accordingly, even though adhesion of the web with the preheater 16 is lowered due to the thermally contracted deformed portion, the preheating is not insufficient. As a result, the toner image is securely fixed to the thermally contracted deformed portion, by the heating roll 18 and the pressurizing roll 20.

After the printing starts, if the printing is continuously performed in a state where the temperature of the preheater 16 of the second printing apparatus P2 is increased to the target temperature, unnecessary power consumption is continuously made, in spite of the thermally contracted deformed portion of the web W already passing through the preheater 16 of the second printing apparatus P2.

In order to avoid this situation in advance, the temperature of the preheater 16 is preferably returned to the normal temperature, when the thermally contracted deformed portion of the web passes through the preheater 16 of the second printing apparatus P2.

For this reason, in the first embodiment, the fact that, if the length of the web W loaded from the preheater 16 of the first printing apparatus P1 to the preheater 16 of the second printing apparatus P2 is known, time needed until the thermally contracted deformed portion of the web reaches the preheater 16 of the second printing apparatus P2 can be calculated and timing (time) when the heating lamp 32 is turned off can be determined from the calculated time is used.

In the first embodiment, an operator previously inputs the length L (web length information L) of the web W loaded from the preheater 16 of the first printing apparatus P1 to the preheater 16 of the second printing apparatus P2, from a screen of the touch panel 46 of the controller 12. The communication unit 47 of the controller 12 transmits the web length information L, which is set by the operator using the touch panel 46, to the microcomputer 40 of the second printing apparatus P2 through the communication unit 44. The microcomputer 40 calculates a regular period T from the received web length information L and the previously set web conveyance velocity v, using the following equation 1. In this case, the regular period means a period from the printing start time t2 to the time t3 until the thermally contracted deformed portion of the web W is conveyed to the preheater 16 of the second printing apparatus P2.

$$T=L/v \tag{1}$$

The microcomputer 40 of the second printing apparatus P2 causes the timer 42 to count the calculated regular period T. For this reason, the microcomputer 40 causes the timer 42 to start to count the time, at the time t2 when the DORMANT signal indicating the printing preparation completion becomes OFF (step S5).

If the timer 42 counts the regular period T from the printing start (Yes in step S6), the microcomputer 40 instructs the temperature control circuit 34 to turn off the heating lamp 32. Thereby, the heating lamp 32 is turned off (step S8) and the temperature of the preheater 16 is returned to the normal temperature.

As such, in the first embodiment, even when the thermally contracted deformed portion is generated in the web W by the preheating from the preheater 16 of the first printing apparatus P1 due to the temporary stop of the printing and adhesion of the thermally contracted deformed portion with the preheater 16 of the second printing apparatus P2 is deteriorated, the appropriate preheating is performed on the thermally contracted deformed portion by the preheater 16 of the second printing apparatus P2, and the amount of heat is added. Therefore, a high-quality printed material can be output without generating a fixing defect of the toner image.

In this embodiment, after the thermally contracted deformed portion of the web W passes through the preheater 16 of the second printing apparatus P2, the temperature of the preheater 16 is returned to the normal temperature. Therefore, unnecessary power consumption can be reduced.

As another method that determines timing when the heating lamp is turned off to prevent the unnecessary power consumption, the number of pages of the conveyed web W is used in the second embodiment. The basic configuration of the web printing system according to the second embodiment is the same as the basic configuration of the first embodiment, and includes the first printing apparatus P1, the second printing apparatus P2, and the controller 12. In this case, the functions and configurations of the first printing apparatus P1 and the controller 12 according to the second embodiment are the same as those of the first embodiment. Similar to the first embodiment, each of the first printing apparatus P1 and the second printing apparatus P2 according to the second embodiment also includes a heat fixing device and the configuration thereof is the same as that of the first embodiment. The second printing apparatus P2 according to the second embodiment also includes a temperature control unit.

Figure 6:
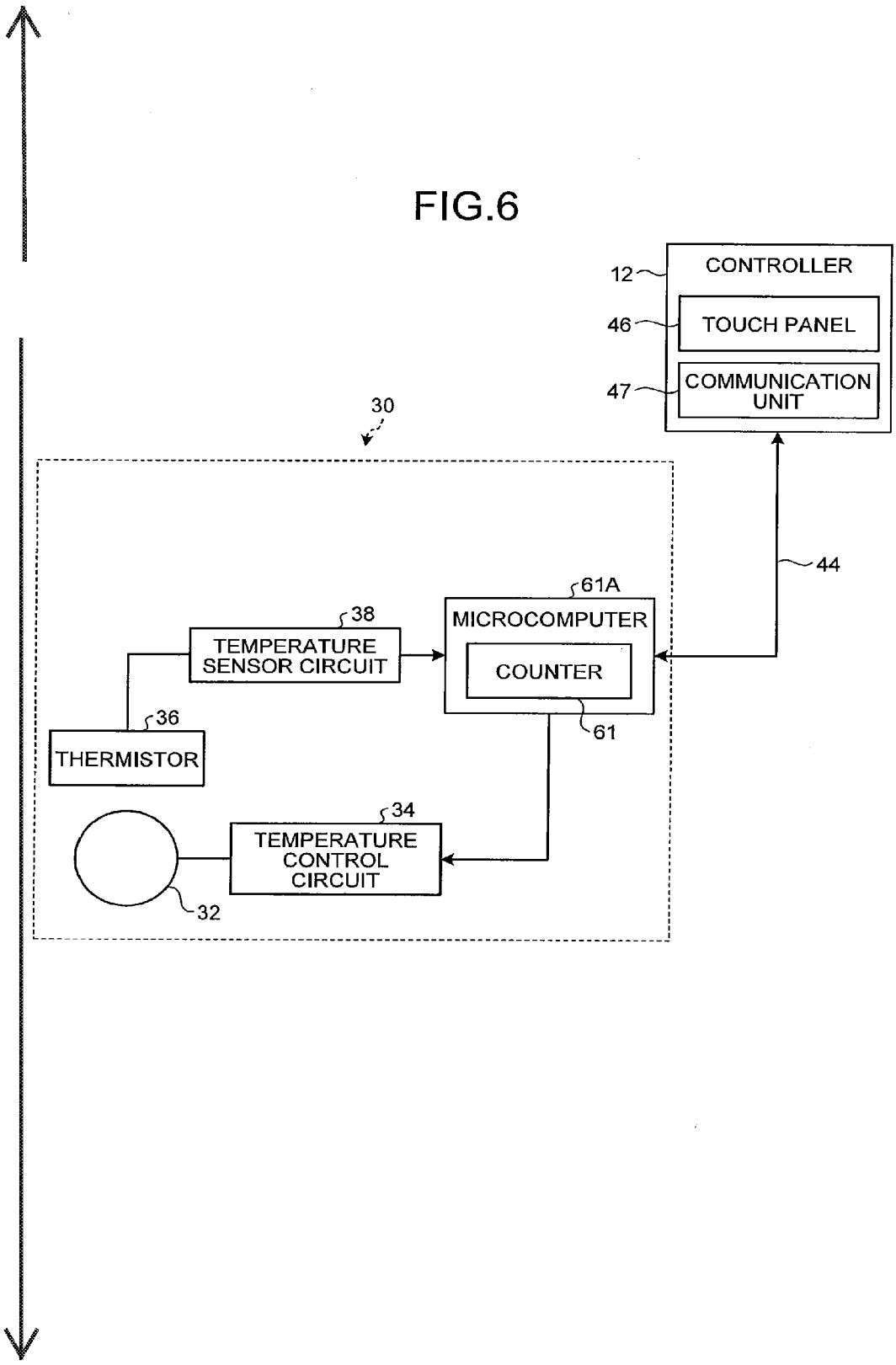
FIG. 6 is a diagram showing an example of the configuration of a temperature control unit according to a second embodiment.

FIG. 6 shows an example of the hardware configuration of the temperature control unit according to the second embodiment. As shown in FIG. 6, the temperature control unit 30 according to the second embodiment has the heating lamp 32, the temperature control circuit 34, the thermistor 36 functioning as a temperature detecting sensor, the temperature sensor circuit 38, and a microcomputer 61A. In this case, the functions and the configurations of the heating lamp 32, the temperature control circuit 34, the thermistor 36, and the temperature sensor circuit 38 are the same as those of the first embodiment.

In the second embodiment, the microcomputer 61A controls the operation of the second printing apparatus P2. The printing apparatus is configured such that the microcomputer can recognize whether a size of each of continuous webs W to be printed is an A4 size or a B5 size, and recognize which page of the current web is printed during the printing.

The microcomputer 61A according to the second embodiment incorporates a counter 61 as a counting unit, and the counter 61 counts the number of pages of the conveyed web W. The microcomputer 61A determines a point of time when the number of pages of the web W counted by the counter 61 becomes a regular page number N as timing when the heating lamp 32 is turned off Accordingly, the temperature control unit 30 according to the second embodiment does not use the timer 42 according to the first embodiment.

In the second embodiment, the regular page number N is determined as follows. The microcomputer 61A of the second printing apparatus P2 calculates the regular page number N from the web length information L set by the operator using the touch panel 46 described in the first embodiment and the length m of a conveyance direction for each page of the web W. In this case, the regular page number N shows the number of pages that the web length information L corresponds.

$$N=L/m \tag{2}$$

Figure 7:
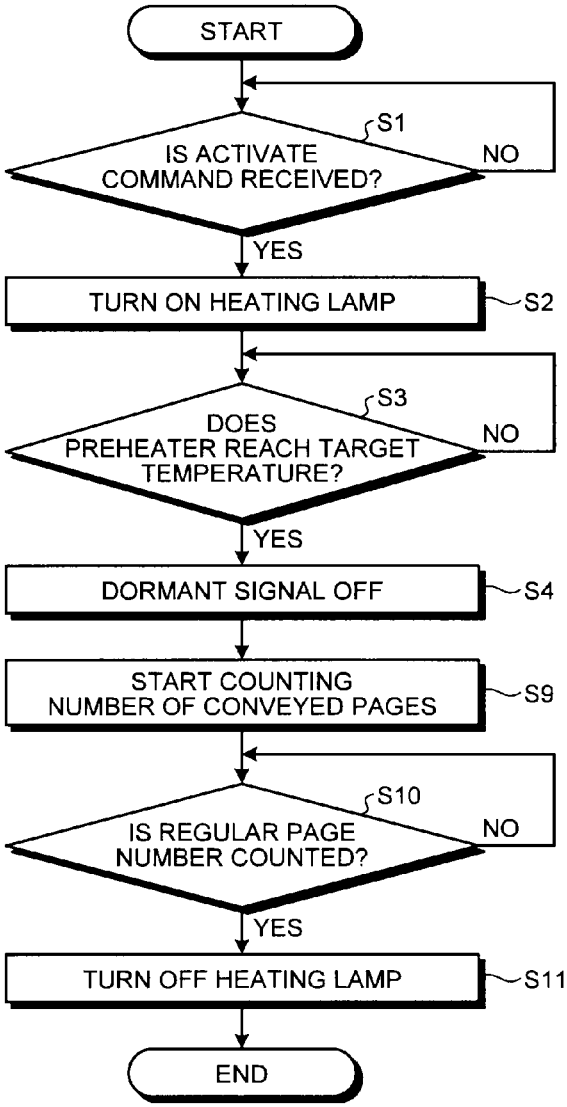
FIG. 7 is a flowchart illustrating a sequence of a temperature control process according to the second embodiment.

An operation of the web printing system according to the second embodiment will be described with reference to FIG. 6. FIG. 7 is a flowchart illustrating a sequence of a temperature control process based on the microcomputer 61A. The processes (steps S1 to S4) until the microcomputer receives the ACTIVATE signal, turns on the heating lamp 32, increases the temperature of the preheater 16 to the target temperature, and causes the DORMANT signal to become OFF are the same as steps S1 to S4 of the first embodiment shown in FIG. 5.

The microcomputer 61A of the second printing apparatus P2 causes the counter 61 to start to count the number of conveyed pages of the web W, at a point of time (time t2) when the DORMANT signal becomes OFF (printing preparation completion) (step S9).

If the number of conveyed pages to be counted reaches the regular page number N (Yes in step S10), the microcomputer 61A instructs the temperature control circuit 34 to turn off the heating lamp 32. Thereby, the heating lamp 32 is turned off (step S11) and the temperature of the preheater 16 is returned to the normal temperature.

As such, according to the second embodiment, similar to the first embodiment, after the thermally contracted deformed portion of the web W passes through the preheater 16 of the second printing apparatus P2, the temperature of the preheater 16 is returned to the normal temperature. Therefore, unnecessary power consumption can be reduced.

As described in the first and second embodiments, the rising temperature of the preheater 16 by the heating lamp 32 is previously set to the microcomputers 40 and 61A. However, an optimal value may be different according to a type or an environment of the web W. Accordingly, it may be difficult to previously set the accurate rising temperature to the microcomputers 40 and 61A of the second printing apparatus P2 as a specification of the printing system. The third embodiment that can address the above situation will be described below. The third embodiment can be applied to the printing systems according to the first and second embodiments.

The basic configuration of the web printing system according to the third embodiment is the same as the basic configuration of the first embodiment, and includes the first printing apparatus P1, the second printing apparatus P2, and the controller 12. In this case, the functions and configurations of the first printing apparatus P1, the second printing apparatus, and the controller 12 according to the third embodiment are the same as those of the first embodiment.

Similar to the setting of the web length information L described above, the operator can input the rising temperature of the preheater 16 using the touch panel 46 of the controller 12 in the third embodiment. In the third embodiment, the rising temperature is set from the screen of the touch panel 46 of the controller 12.

In this case, the rising temperature is previously set on the basis of the experiment result. For example, in the case of paper of a type where thermal deformation is relatively large, the temperature that is higher than the normal temperature by about 10° C. is generally set. In the case of paper of a type where thermal deformation is relatively small, the temperature that is higher than the normal temperature by about 5° C. is generally set. However, the invention is not limited thereto.

The communication unit 47 of the controller 12 transmits the set rising temperature information to the microcomputer 40 of the second printing apparatus P2.

If the microcomputer 40 of the second printing apparatus P2 receives the ACTIVATE command from the controller 12, the microcomputer 40 increases the temperature of the preheater 16 by the instructed rising temperature, and starts the printing after the temperature reaches the target temperature.

According to the third embodiment, since the rising temperature of the preheater 16 by the heating lamp 32 can be set to the optical value according to the type or environment of the web, the thermally contracted deformed portion of the web can be optimally preheated by the preheater 16.

When the temporary uncontrolled time of the web W on the preheater 16 of the first printing apparatus P1 is short, it is assumed that the thermally contracted deformed portion of the web W is small. In this case, normal printing is enabled at the normal temperature without increasing the temperature of the preheater 16 of the second printing apparatus P2.

The fourth embodiment that can address the above situation will be described below. The fourth embodiment can be applied to the printing systems according to the first, second, third embodiments.

The basic configuration of the web printing system according to the fourth embodiment is the same as the basic configuration of the first embodiment, and includes the first printing apparatus P1, the second printing apparatus P2, and the controller 12. In this case, the functions and configurations of the first printing apparatus P1, the second printing apparatus P2, and the controller 12 according to the fourth embodiment are the same as those of the first embodiment.

Figure 8:
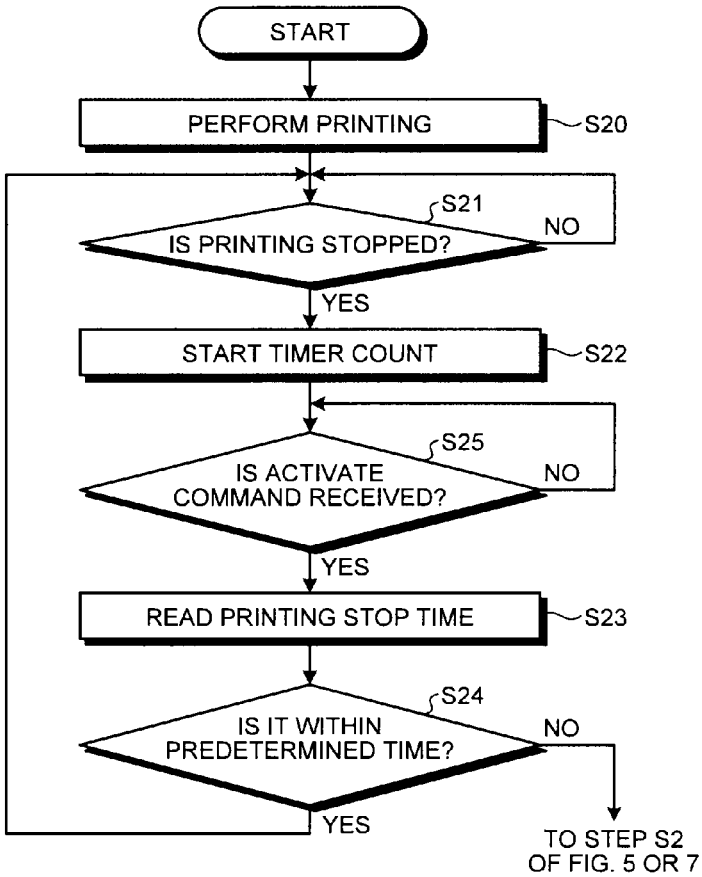
FIG. 8 is a flowchart illustrating a sequence of a temperature control process according to a fourth embodiment.

An operation of the web printing system according to the fourth embodiment will be described with reference to FIG. 8. FIG. 8 is a flowchart illustrating only the control based on the microcomputer 40 according to the fourth embodiment. The flow of FIG. 8 is a previous step of step S2 of FIGS. 5 and 7.

In the fourth embodiment, printing is performed once (step S20). If the microcomputer 40 of the second printing apparatus P2 recognizes the printing stop of the printing system (Yes in step S21), the microcomputer 40 causes the timer 42 to start a count operation (step S22). If the microcomputer 40 receives the ACTIVATE command from the controller 12 (step S25), the microcomputer 40 reads the time counted by the timer 42 and resets the timer (step S23). In this case, the read time is called a printing stop time. Accordingly, the printing stop time is time until the time t1 when the ACTIVATE command is received after the printing is stopped.

The microcomputer 40 determines whether the measured printing stop time is within the predetermined time (for example, within 5 sec.) (step S24). If the printing stop time is within the predetermined time (Yes in step S24), the process returns to step S21 without executing the temperature control of the preheater 16 based on the heating lamp 32.

Meanwhile, if the printing stop time is longer than the predetermined time (step S24: No), the process proceeds to step S2 of FIGS. 5 and 7, and the temperature control of the preheater 16 based on the heating lamp 32 is executed.

As such, according to the fourth embodiment, since unnecessary temperature control can be excluded, the unnecessary power consumption can be removed.

The first to fourth embodiments are to avoid the fixing defect in the thermally contracted deformed portion of the web W on the preheater 16 of the first printing apparatus P1. Meanwhile, the fifth embodiment is to avoid a fixing defect in a deformed portion other than the thermally contracted deformed portion of the web W.

For example, if a printing operation is temporarily stopped due to occurrence of a failure or the operator temporarily stops the printing operation due to other circumstances, the web W is left loaded on the first printing apparatus P1 and the second printing apparatus P2 in a non-printing state.

Figure 9:
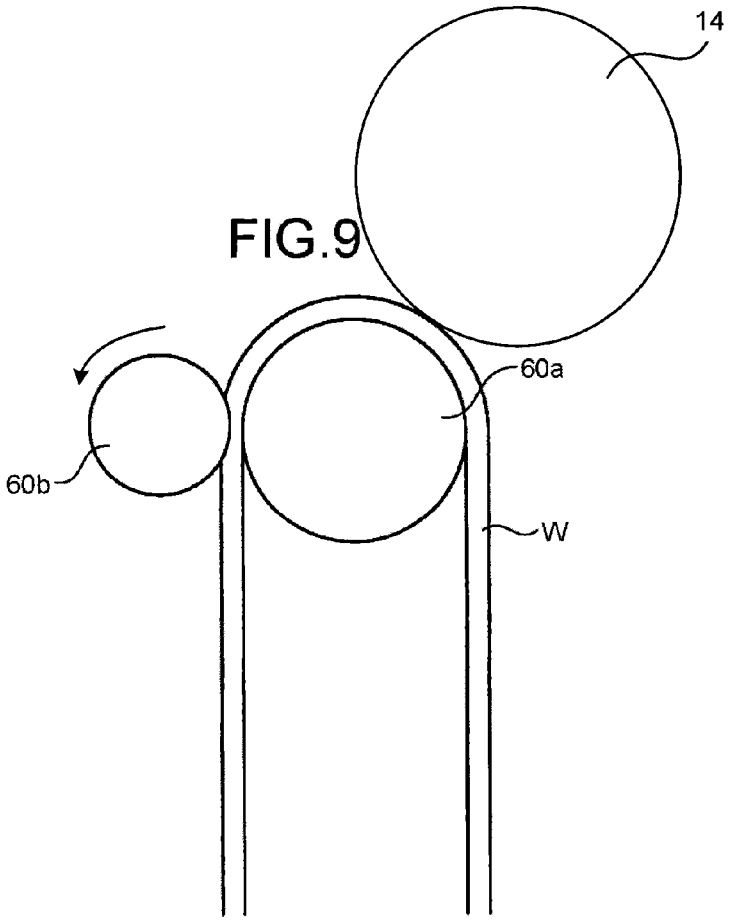
FIG. 9 is a diagram showing the configuration of a pair of conveying rollers that are provided in a first printing apparatus according to the third embodiment.

FIG. 9 shows the configuration of a pair of conveying rollers that are provided in the first printing apparatus P1 according to the third embodiment. As shown in FIG. 9, in the printing apparatus P1, if the web W is uncontrolled for a long time in a state where the web is nipped by conveying rollers 60*a* and 60*b* disposed in front (upstream) of the preheater 16, the web W is partially deformed.

In this state, if the printing starts, when the deformed portion passes through the upper side of the preheater 16, adhesion of the web with the preheater 16 is lowered due to the deformation, the heat cannot be sufficiently obtained from the preheater 16, and the preheating of the web W before entering into the heating roll 18 and the pressurizing roll 20 may be insufficient. As a result, the amount of heat that is received by the toner image may be insufficient and a local fixing defect may occur.

For this reason, in the fifth embodiment, the temperature control unit 30 is provided in the first printing apparatus P1, turning on/off of the heating lamp 32 is controlled by the microcomputer 40 in the temperature control unit 30 of the first printing apparatus P1, and the temperature of the preheater 16 of the first printing apparatus P1 is controlled.

The basic configuration of the web printing system according to the fifth embodiment is the same as the basic configuration of the first embodiment, and includes the first printing apparatus P1, the second printing apparatus P2, and the controller 12. The functions and configurations of the first printing apparatus P1, the second printing apparatus P2, and the controller 12 according to the fifth embodiment are the same as those of the first embodiment. The configuration of the temperature control unit 30 of the first printing apparatus P1 is the same as that of the temperature control unit 30 according to the first embodiment.

Figure 10:
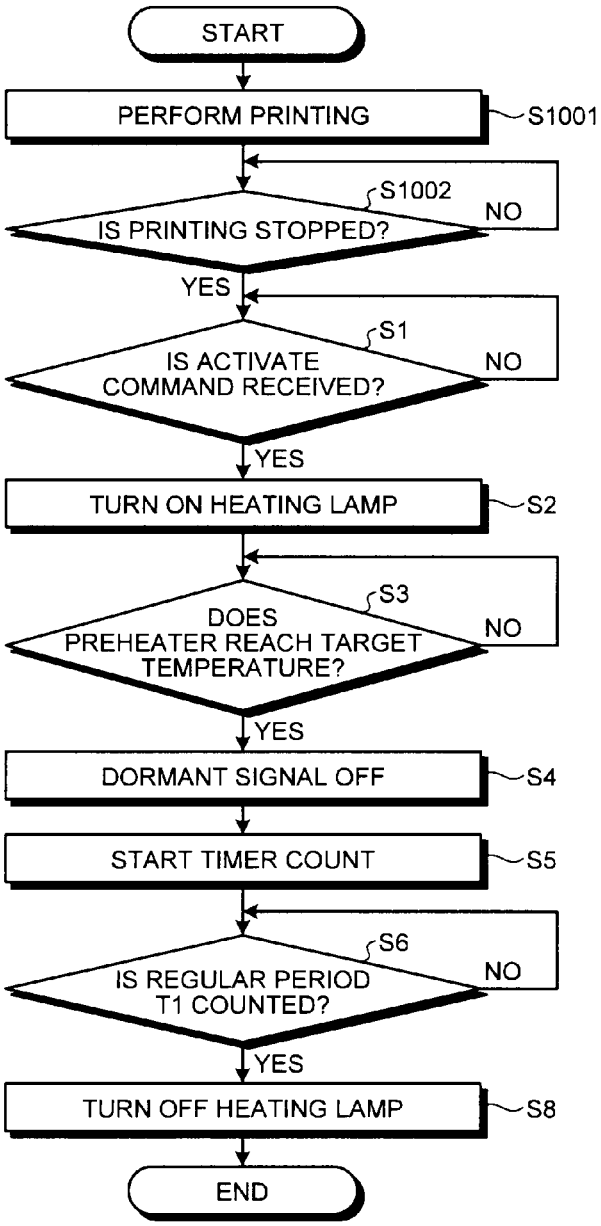
FIG. 10 is a flowchart illustrating a sequence of a temperature control process according to a fifth embodiment.

An operation of the web printing system 10 according to the fifth embodiment will be described with reference to FIG. 10. FIG. 10 is a flowchart illustrating a sequence of a temperature control process based on the microcomputer 40 of the first printing apparatus P1 according to the fifth embodiment.

The web printing system 10 executes a printing process once (step S1001) and enters a temporary printing stop state (Yes in step S1002). At this time, in the printing apparatus P1, the web W is uncontrolled in a state where the web W is nipped by the conveying rollers 60*a* and 60*b*, and the web W is partially deformed.

For this reason, in the web printing system 10 according to the fifth embodiment, when the printing restarts, if the microcomputer 40 of the first printing apparatus P1 receives an ACTIVATE command corresponding to a printing start preparation instruction from the controller 12 at time t1 (Yes in step S1), the microcomputer 40 performs a printing preparation operation and instructs the temperature control circuit 34 to turn on the heating lamp 32 corresponding to the heat source of the preheater 16 to increase the temperature of the preheater 16 from the normal temperature to the target temperature by the rising temperature previously set to the microcomputer 40, similar to the first embodiment. Thereby, the heating lamp 32 is turned on and the preheater 16 is heated (step S2).

The temperature of the preheater 16 is detected by the thermistor 36, is converted into an electric signal by the temperature sensor circuit 38, and is transmitted to the microcomputer 40. The microcomputer 40 continuously monitors the temperature of the preheater 16 and monitors whether the temperature of the preheater 16 reaches the target temperature held by the microcomputer 40 (step S3). In this case, the target temperature means the temperature that corresponds to the amount of heat of the preheating, which is applied to the back surface of the web where the deformed portion exists and needed to melt and fix the toner image in the heat fixing device 50 of the first printing apparatus P1.

If the temperature of the preheater 16 reaches the target temperature at time t2 (Yes in step S3), the microcomputer 40 causes the DORMANT signal supplied to a controller 11 to become OFF to cause the second printing apparatus P2 to inform the printing preparation completion (step S4). If the controller 12 recognizes that the DORMANT signal becomes OFF at the time t2, the controller 12 instructs the microcomputer 40 of each of the first and second printing apparatuses P1 and P2 to start the printing operation.

If the deformed portion of the web W reaches the preheater 16 of the first printing apparatus P1, the deformed portion is preheated by the preheater 16 at the target temperature higher than the normal temperature. Accordingly, even though adhesion of the web with the preheater 16 is lowered due to the deformation of the deformed portion, the preheating is not insufficient. As a result, the toner image is securely fixed to the deformed portion, by the heating roll 18 and the pressurizing roll 20.

If the deformed portion of the web passes through the preheater 16 of the first printing apparatus P1, the temperature of the preheater 16 is returned to the normal temperature.

For this reason, in the fifth embodiment, the length (web length information L1) of the web W that is loaded from the conveying rollers 60*a* and 60*b* of the first printing apparatus P1 to the preheater 16 of the first printing apparatus P1 is previously calculated, time needed until the deformed portion of the web reaches the preheater 16 of the first printing apparatus P1 is calculated, and timing (time) when the heating lamp 32 is turned off is determined from the calculated time.

Specifically, in the fifth embodiment, the operator previously inputs the length L1 (web length information L1) of the web W loaded from the conveying rollers 60*a* and 60*b* of the first printing apparatus P1 to the preheater 16 of the first printing apparatus P1, from a screen of the touch panel 46 of the controller 12. The communication unit 47 of the controller 12 transmits the web length information L1, which is set by the operator using the touch panel 46, to the microcomputer 40 of the first printing apparatus P1 through the communication unit 44. The microcomputer 40 calculates a regular period T1 from the received web length information L1 and the previously set web conveyance velocity v, using the following equation 3. In this case, the regular period T1 means a period from the printing start time t2 to the time t3 until the deformed portion of the web W is conveyed to the preheater 16 of the first printing apparatus P1.

$$T1=L1/v \tag{3}$$

The microcomputer 40 of the first printing apparatus P1 causes the timer 42 to count the calculated regular period T1. For this reason, the microcomputer 40 causes the timer 42 to start to count the time, at the time t2 when the DORMANT signal indicating the printing preparation completion becomes OFF (step S5).

If the timer 42 counts the regular period T1 from the printing start (Yes in step S6), the microcomputer 40 instructs the temperature control circuit 34 to turn off the heating lamp 32. Thereby, the heating lamp 32 is turned off (step S8) and the temperature of the preheater 16 is returned to the normal temperature.

As such, in the fifth embodiment, even when the deformed portion is generated in the web W by nipping the web by the conveying rollers 60*a* and 60*b* of the first printing apparatus P1 due to the temporary stop of the printing and adhesion of the deformed portion with the preheater 16 of the first printing apparatus P1 is deteriorated, the appropriate preheating is performed on the deformed portion by the preheater 16 of the first printing apparatus P1, and the amount of heat is added. Therefore, a high-quality printed material can be output without generating a fixing defect of the toner image.

In the fifth embodiment, after the thermally contracted deformed portion of the web W passes through the preheater 16 of the first printing apparatus P1, the temperature of the preheater 16 is returned to the normal temperature. Therefore, unnecessary power consumption can be reduced.

In the fifth embodiment, the example of the case where the deformed portion of the web W generated by the first printing apparatus P1 is appropriately preheated by the preheater 16 of the first printing apparatus P1 is described. Alternatively, the deformed portion of the web W generated by the second printing apparatus P2 may be appropriately preheated by the preheater 16 of the second printing apparatus P2. Alternatively, the deformed portion of the web W generated by the first printing apparatus P1 may be appropriately preheated by the preheater 16 of the second printing apparatus P2.

The embodiments are described based on the example in which the deformed portion of the web W which is resulting from the nipping by the pair of conveying rollers 60*a* and 60*b* while the printing is suspended is appropriately preheated by the use of the preheater 16, but the invention is not limited such that the deformed portion means only the deformed portion that is generated by the nipping of the web W by the pair of conveying rollers 60*a* and 60*b*. That is, the invention may be configured such that the deformed portion of the web W, which is formed in a long period of contact with a certain mechanism, is appropriately preheated by the preheater 16.

According to an embodiment, even when the deformed portion of the web does not adhere well with a preheating unit deteriorates, appropriate preheating is performed on the deformed portion and an appropriate amount of heat is added to the deformed portion. Therefore, a fixing defect of a toner image does not occur, a high-quality printed material can be output, and unnecessary power consumption can be reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A printing system comprising:

a first printing apparatus including a first preheating unit that preheats a second surface of a long recording medium before a toner image is thermally fixed to a first surface of the recording medium that is opposite to the second surface;

a second printing apparatus provided at a rear stage of the first printing apparatus, the second printing apparatus including;

a second preheating unit that preheats the first surface before a toner image is thermally fixed to the second surface, a temperature control unit that performs control to increase the temperature of the second preheating unit from a normal temperature to a target temperature in response to a printing preparation instruction; and a control device that controls a printing operation of each of the first and second printing apparatuses, the control device issuing the printing preparation instruction when the printing system is in a temporary printing stop state that lasts until printing restarts from when the printing is performed once, the control device restarting printing of the first and second printing apparatuses when the temperature of the second preheating unit reaches the target temperature, wherein the temperature control unit performs control to decrease the temperature of the second preheating unit from the target temperature to the normal temperature, when an elapsed time since the printing of the first and second printing apparatuses was restarted reaches a time calculated based on a length of the recording medium loaded on a conveyance path of the recording medium between the first preheating unit and the second preheating unit.

2. The printing system according to claim 1, wherein the second printing apparatus further includes a first timing unit that detects the time calculated based on the length of the recording medium loaded on the conveyance path of the recording medium between the first preheating unit and the second preheating unit.

3. The printing system according to claim 2, wherein the control device includes an input unit that receives the length of the recording medium loaded on the conveyance path of the recording medium from the first preheating unit to the second preheating unit, which is input from a user, and a transmitting unit that transmits the input length of the recording medium to the second printing apparatus.

4. The printing system according to claim 1, wherein the second printing apparatus further includes a counting unit that detects the time calculated based on the length of the recording medium loaded on the conveyance path of the recording medium between the first preheating unit and the second preheating unit, the length of the recording medium being determined by a number of pages of the recording medium loaded on the conveyance path.

5. The printing system according to claim 1, wherein the control device includes an input unit that receives the target temperature input from a user; and a transmitting unit that transmits the input target temperature to the second printing apparatus.

6. The printing system according to claim 1, wherein the second printing apparatus further includes a second timing unit that counts a printing stop time for which the printing system is in the temporary printing stop state, and the temperature control unit determines whether temperature control of the second preheating unit is executed according to the printing stop time counted by the second timing unit, when a printing preparation instruction is received from the control device.

7. The printing system according to claim 1, wherein the first printing apparatus includes a contact member that contacts the recording medium and is arranged upstream of the first preheating unit, and a first printing apparatus temperature control unit that performs control to increase the temperature of the first preheating unit from the normal temperature to the target temperature in response to a printing preparation instruction being received from the control device when the printing system is in the temporary printing stop state, the control device restarts printing of the first printing apparatus when the temperature of the first preheating unit reaches the target temperature, and the first printing apparatus temperature control unit performs control to decrease the temperature of the first preheating unit from the target temperature to the normal temperature when an elapsed time since the printing of the first printing apparatus was restarted reaches a time calculated based on a length of the recording medium loaded on a conveyance path of the recording medium from the contact member to the first preheating unit.

8. The printing system according to claim 7, wherein the contact member is a pair of conveying rollers that convey and nip the recording medium.

9. A printing apparatus, comprising:

a preheating unit that preheats a second surface of a long recording medium before a toner image is thermally fixed to a first surface of the recording medium that is opposite to the second surface;

a contact member that contacts the recording medium and is arranged upstream of the preheating unit;

a temperature control unit that performs control to increase the temperature of the preheating unit from a normal temperature to a target temperature in response to a printing preparation instruction issued when the printing apparatus is in a temporary printing stop state that lasts until printing restarts from when the printing is performed once; and a control unit that restarts the printing when the temperature of the preheating unit reaches the target temperature, wherein the temperature control unit performs control to decrease the temperature of the preheating unit from the target temperature to the normal temperature when an elapsed time since the printing of the printing apparatus was restarted reaches a time calculated based on a length of the recording medium loaded on a conveyance path of the recording medium from the contact member to the preheating unit.

10. The printing system according to claim 9, wherein the contact member is a pair of conveying rollers that convey and nip the recording medium.

11. A printing method that is executed in a printing system including a first printing apparatus, a second printing apparatus provided at a rear stage of the first printing apparatus, and a control device to control a printing operation of each of the first and second printing apparatuses, in which the first printing apparatus includes a first preheating unit that preheats a second surface of a long recording medium before a toner image is thermally fixed to a first surface of the recording medium that is opposite to the second surface and the second printing apparatus includes a second preheating unit that preheats the first surface before a toner image is thermally fixed to the second surface, the printing method comprising:

causing the second printing apparatus to perform control to increase the temperature of the second preheating unit from a normal temperature to a target temperature in response to a printing preparation instruction;

causing the control device to issue the printing preparation instruction when the printing system is in a temporary printing stop state that lasts until printing restarts from when the printing is performed once;

causing the control device to restart printing of the first and second printing apparatuses when the temperature of the second preheating unit reaches the target temperature; and causing the second printing apparatus to perform control to decrease the temperature of the second preheating unit from the target temperature to the normal temperature when an elapsed time since the printing of the first and second printing apparatuses was restarted reaches a time calculated based on a length of the recording medium loaded on a conveyance path of the recording medium between the first preheating unit and the second preheating unit.

* * * * *